US010001303B2

(12) United States Patent
Ueda et al.

(10) Patent No.: US 10,001,303 B2
(45) Date of Patent: Jun. 19, 2018

(54) ROTARY COMPRESSOR

(71) Applicant: FUJITSU GENERAL LIMITED, Kanagawa (JP)

(72) Inventors: Kenshi Ueda, Kanagawa (JP); Junya Tanaka, Kanagawa (JP); Kenji Komine, Kanagawa (JP); Shuhei Hoshino, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 113 days.

(21) Appl. No.: 15/155,892

(22) Filed: May 16, 2016

(65) Prior Publication Data

US 2017/0003057 A1 Jan. 5, 2017

(30) Foreign Application Priority Data

Jun. 30, 2015 (JP) ..... 2015-132006

(51) Int. Cl.
*F01C 21/00* (2006.01)
*F03C 2/00* (2006.01)
(Continued)

(52) U.S. Cl.
CPC ..... *F25B 31/026* (2013.01); *F01C 21/08* (2013.01); *F01C 21/0881* (2013.01);
(Continued)

(58) Field of Classification Search
CPC ..... F25B 31/026; F01C 21/08; F04C 18/3564
(Continued)

(56) References Cited

U.S. PATENT DOCUMENTS

2012/0174617 A1 7/2012 Aoki et al.
2016/0138593 A1 5/2016 Tanaka et al.

FOREIGN PATENT DOCUMENTS

JP 03138479 A * 6/1991
JP 10-082390 A 3/1998
(Continued)

OTHER PUBLICATIONS

Espacenet English translation of JPH03138479, dated Sep. 28, 2017.*
(Continued)

*Primary Examiner* — Deming Wan
(74) *Attorney, Agent, or Firm* — McDermott Will & Emery LLP

(57) ABSTRACT

A rotary compressor includes a sealed vertical compressor housing, a compressing unit, and a motor. A refrigerant discharging unit is provided at an upper part and a refrigerant intake unit is provided at a lower part side surface in the sealed vertical compressor housing. The compressing unit is disposed on the lower part of the compressor housing, includes an annular cylinder, an end plate including a bearing unit and a discharge valve unit and blocking end portions of the cylinder, an annular piston that engages with an eccentric portion of a rotation axis supported by the bearing unit, revolves along a cylinder inner wall of the cylinder in the cylinder, and forms a cylinder chamber between the cylinder inner wall and the annular piston, and a vane. The motor is disposed on the upper part of the compressor housing, and drives the compressing unit via the rotation axis.

1 Claim, 3 Drawing Sheets

(51) Int. Cl.

| | |
|---|---|
| ***F04C 2/344*** | (2006.01) |
| ***F04C 15/00*** | (2006.01) |
| ***F04C 29/00*** | (2006.01) |
| ***F01C 1/344*** | (2006.01) |
| ***F04C 18/344*** | (2006.01) |
| ***F25B 31/02*** | (2006.01) |
| ***F01C 21/08*** | (2006.01) |
| ***F04C 18/356*** | (2006.01) |
| ***F25B 31/00*** | (2006.01) |
| ***F25B 43/00*** | (2006.01) |
| ***F25B 47/00*** | (2006.01) |

(52) U.S. Cl.
CPC ..... *F04C 18/3564* (2013.01); *F25B 31/002* (2013.01); *F25B 43/006* (2013.01); *F25B 47/003* (2013.01); *F04C 2230/21* (2013.01); *F04C 2230/91* (2013.01)

(58) Field of Classification Search
USPC ..... 418/178, 179, 64, 235, 145, 146, 63, 60, 418/249, 234
See application file for complete search history.

(56) References Cited

FOREIGN PATENT DOCUMENTS

| | | | | |
|---|---|---|---|---|
| JP | 2001271774 A | * | 10/2001 | ..... F04C 18/3564 |
| JP | 5543973 B2 | | 7/2014 | |
| WO | 2015/045433 A1 | | 4/2015 | |

OTHER PUBLICATIONS

Extended European Search Report issued in corresponding EP Patent Application No. 16176958.3, dated Dec. 6, 2016.

* cited by examiner

ROTARY COMPRESSOR

CROSS-REFERENCE TO RELATED APPLICATION

This application is based upon and claims the benefit of priority of the prior Japanese Patent Application No. 2015-132006, filed on Jun. 30, 2015, the entire contents of which are incorporated herein by reference.

FIELD

The present invention relates to a rotary compressor used in an air conditioner or a refrigerating machine.

BACKGROUND

For example, Japanese Patent No. 5543973 (Patent Document 1) discloses a refrigerant compressor that includes a compressing unit that compresses a refrigerant and is used in a refrigeration cycle; a vane that is slidably provided in the compressing unit and is formed of a metal material as base material; a coating film formed by sequentially stacking first to fourth layers on the surface of the base material; a roller that is rotatably provided in the compressing unit and with which a tip end of the vane is in sliding contact; and a cylinder that is provided in the compressing unit and accommodates the vane and the roller. In the refrigerant compressor, the first layer is formed of a chromium single layer, the second layer is formed of an alloy layer of chromium and tungsten carbide, the third layer is formed of an amorphous carbon layer containing metal containing at least one of tungsten and tungsten carbide, and the fourth layer is formed of an amorphous carbon layer (diamond-like carbon layer) not containing metal and containing carbon and hydrogen, and in the second layer, a content rate of chromium is higher on the first layer side than on the third layer side, and the content rate of tungsten carbide is higher on the third layer side than on the first layer side.

In addition, Japanese Laid-open Patent Publication No. 10-82390 (Patent Document 2) discloses a sliding member that includes a sliding member main body (vane) having a sliding surface; an intermediate layer provided on the sliding surface; a hard carbon coating film (diamond-like carbon coating film) provided on the intermediate layer; and a mixed layer that is formed of the components of the intermediate layer and carbon and is formed in a region inside the intermediate layer in the vicinity of the surface of the intermediate layer. In the sliding member, the mixed layer has a carbon concentration gradient such that the carbon concentration of a part close to the surface of the mixed layer is higher than that of a part separated from the surface.

However, since the vane disclosed in Patent Document 1 includes the alloy layer (second layer) and the diamond-like carbon layer (third layer) containing metal as the intermediate layers, between the chromium single layer (first layer) of the surface of the base material and the diamond-like carbon layer (fourth layer) as the sliding surface, the intermediate layers become thick, and thus the hardness difference is generated between the layers. Therefore, there is a problem in that internal residual stress is increased and the diamond-like carbon layer (fourth layer) as the sliding surface is easily peeled off.

In addition, the tungsten contained in the second and third layers is easily oxidized by acidic substances. After the oxidation, there is a problem in that the tungsten is reduced by alkaline substances so as to be easily peeled off (in the refrigerant compressor, acidic substances are present due to the deterioration of refrigerating machine oil (lubricant oil) and alkaline substances are also present due to the residue of a cleaning agent for components). Furthermore, since the number of the coating layers is as large as four, an increase in costs due to the increase in time for the film formation is also a concern.

The vane disclosed in Patent Document 2 has a problem of the adhesion (bonding properties) between the vane main body and the mixed layer as the first layer. If the vane repeatedly receives compressive stress, there is a problem in that peeling off or cracks may occur between the vane main body and the mixed layer as the first layer. In addition, in a case where tungsten, which is the constituent element of the base material of the vane is contained in the mixed layer, peeling off occurs more easily.

SUMMARY

According to an aspect of the embodiments, a rotary compressor includes: a sealed vertical compressor housing in which a refrigerant discharging unit is provided at an upper part and a refrigerant intake unit is provided at a lower part side surface; a compressing unit which is disposed on the lower part of the compressor housing, includes an annular cylinder, an end plate including a bearing unit and a discharge valve unit and blocking end portions of the cylinder, an annular piston that engages with an eccentric portion of a rotation axis supported by the bearing unit, revolves along a cylinder inner wall of the cylinder in the cylinder, and forms a cylinder chamber between the cylinder inner wall and the annular piston, and a vane that protrudes away from a vane groove provided in the cylinder into the cylinder chamber and is in contact with the annular piston so as to divide the cylinder chamber into an inlet chamber and a compression chamber, sucks a refrigerant through the intake unit, and discharges the refrigerant from the discharging unit through the compressor housing; and a motor that is disposed on the upper part of the compressor housing, and drives the compressing unit via the rotation axis. A parent material of the vane is a steel material containing chromium. A single coating layer of chromium as a first layer, an intermediate coating layer including a concentration gradient of chromium and carbon as a second layer, and a diamond-like carbon coating layer as a third layer are formed on a sliding surface in contact with the annular piston, in order starting from the surface of the parent material. The intermediate coating layer has a chromium concentration higher than a carbon concentration on the first layer side and has the carbon concentration higher than the chromium concentration on the third layer side.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Hereinafter, an embodiment (example) of the invention will be described in detail with reference to the drawings.

Example

Figure 1:
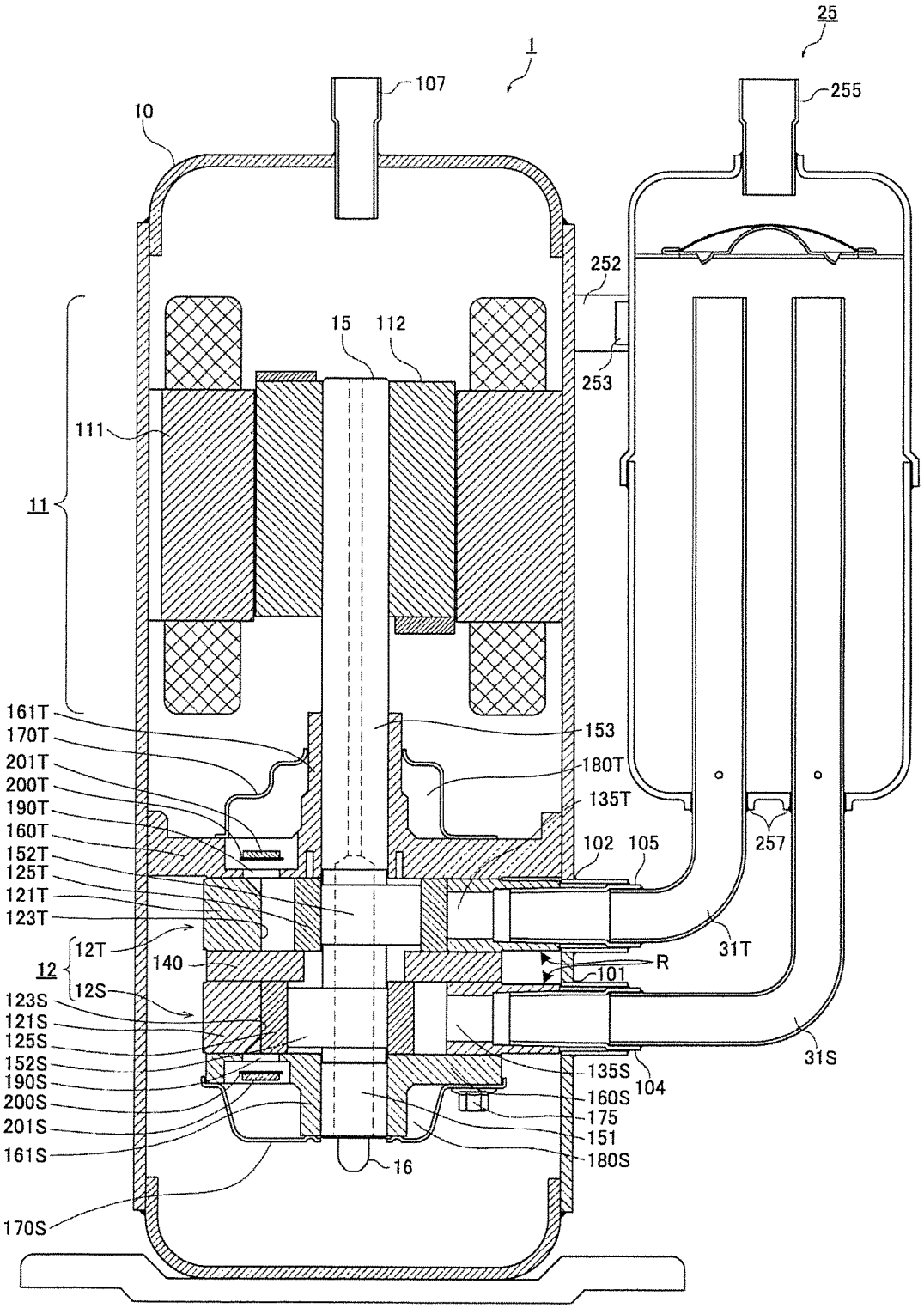
FIG. 1 is a vertical sectional view illustrating an example of a rotary compressor according to an embodiment of the invention.
Figure 2:
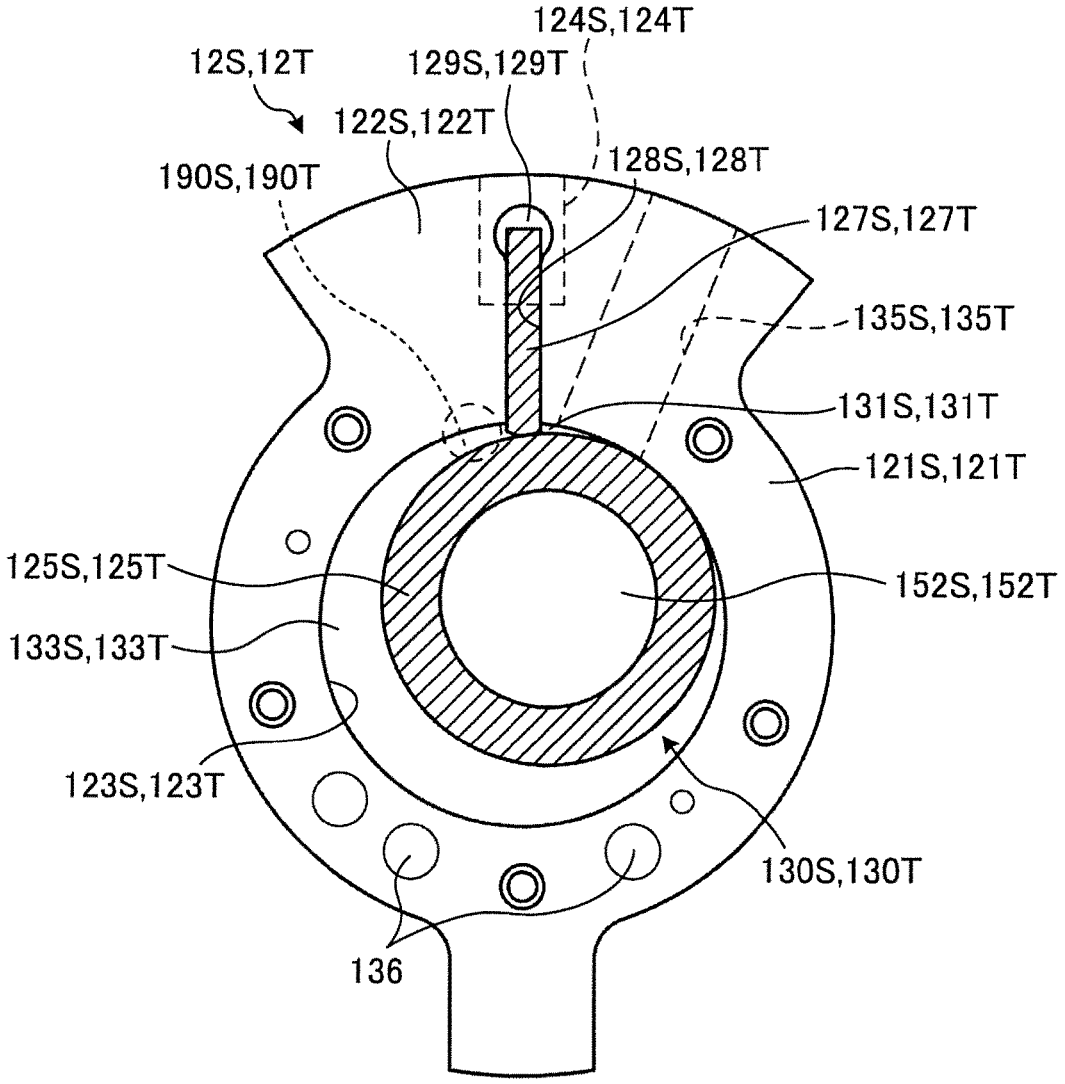
FIG. 2 is a cross-sectional view illustrating a first compressing unit and a second compressing unit of the example, when seen from above.

FIG. 1 is a vertical sectional view illustrating an example of a rotary compressor according the embodiment of to the invention. FIG. 2 is a cross-sectional view illustrating a first compressing unit and a second compressing unit of the rotary compressor of the example, when seen from above.

As illustrated in FIG. 1, a rotary compressor 1 includes a compressing unit 12 that is disposed on a lower part of a compressor housing 10 that is sealed and has a vertical cylindrical shape, and a motor 11 that is disposed on an upper part of the compressor housing 10 and drives the compressing unit 12 via a rotation axis 15.

A stator 111 of the motor 11 is formed in a cylindrical shape and is fixed to an inner circumferential surface of the compressor housing 10 by shrink-fitting. A rotor 112 of the motor 11 is disposed in the cylindrical stator 111 and is fixed to the rotation axis 15 by shrink-fitting which mechanically connects the motor 11 and the compressing unit 12.

The compressing unit 12 includes a first compressing unit 12S and a second compressing unit 12T. As illustrated in FIG. 2, the first compressing unit 12S includes an annular first cylinder 121S. The first cylinder 121S includes a first side-flared portion 122S that projects away from the annular outer circumference. A first inlet hole 135S and a first vane groove 128S are radially provided in the first side-flared portion 122S. In addition, the second compressing unit 12T is disposed on the upper side of the first compressing unit 12S. The second compressing unit 12T includes an annular second cylinder 121T. The second cylinder 121T includes a second side-flared portion 122T that projects away from the annular outer circumference. A second inlet hole 135T and a second vane groove 128T are radially provided in the second side-flared portion 122T.

As illustrated in FIG. 2, a first cylinder inner wall 123S having a circular shape is formed in the first cylinder 121S to be concentric with the rotation axis 15 of the motor 11. A first annular piston 125S having an outer diameter smaller than an inner diameter of the first cylinder 121S is disposed in the first cylinder inner wall 123S. A first cylinder chamber 130S that sucks, compresses, and discharges a refrigerant is formed between the first cylinder inner wall 123S and the first annular piston 125S. A second cylinder inner wall 123T having a circular shape is formed in the second cylinder 121T to be concentric with the rotation axis 15 of the motor 11. A second annular piston 125T having an outer diameter smaller than an inner diameter of the second cylinder 121T is disposed in the second cylinder inner wall 123T. A second cylinder chamber 130T that sucks, compresses, and discharges a refrigerant is formed between the second cylinder inner wall 123T and the second annular piston 125T.

In the first cylinder 121S, the first vane groove 128S is formed along the entire height of the cylinder in a radial direction away from the first cylinder inner wall 123S. A flat first vane 127S is slidably fitted in the first vane groove 128S. In the second cylinder 121T, the second vane groove 128T is formed along the entire height of the cylinder in the radial direction away from the second cylinder inner wall 123T. A flat second vane 127T is slidably fitted in the second vane groove 128T.

As illustrated in FIG. 2, a first spring bore 124S is formed on the outer side of the first vane groove 128S in the radial direction so as to communicate with the first vane groove 128S from an outer circumferential portion of the first side-flared portion 122S. A first vane spring (not illustrated) that presses a rear surface of the first vane 127S is inserted into the first spring bore 124S. A second spring bore 124T is formed on the outer side of the second vane groove 128T in the radial direction so as to communicate with the second vane groove 128T from an outer circumferential portion of the second side-flared portion 122T. A second vane spring (not illustrated) that presses a rear surface of the second vane 127T is inserted into the second spring bore 124T.

At the time of activating the rotary compressor 1, the first vane 127S protrudes away from the first vane groove 128S into the first cylinder chamber 130S due to the repulsive force of the first vane spring. A tip end of the first vane 127S is in contact with an outer circumferential surface of the first annular piston 125S, and by the first vane 127S, the first cylinder chamber 130S is divided into a first inlet chamber 131S and a first compression chamber 133S. Similarly, the second vane 127T protrudes away from the second vane groove 128T into the second cylinder chamber 130T due to the repulsive force of the second vane spring. A tip end of the second vane 127T is in contact with an outer circumferential surface of the second annular piston 125T, and by the second vane 127T, the second cylinder chamber 130T is divided into a second inlet chamber 131T and a second compression chamber 133T (the details of the first vane 127S and the second vane 127T are described below).

In addition, in the first cylinder 121S, a first pressure guiding-in path 129S is formed which communicates with the outer side of the first vane groove 128S in the radial direction and the inside of the compressor housing 10 via an opening portion R (refer to FIG. 1), introduces the compressed refrigerant in the compressor housing 10, and applies back pressure to the first vane 127S by the pressure of the refrigerant. The compressed refrigerant in the compressor housing 10 is also introduced through the first spring bore 124S. In addition, in the second cylinder 121T, a second pressure guiding-in path 129T is formed which communicates with the outer side of the second vane groove 128T in the radial direction and the inside of the compressor housing 10 via the opening portion R (refer to FIG. 1), introduces the compressed refrigerant in the compressor housing 10, and applies back pressure to the second vane 127T by the pressure of the refrigerant. The compressed refrigerant in the compressor housing 10 is also introduced through the second spring bore 124T.

The first inlet hole 135S, which causes the first inlet chamber 131S and an external unit to communicate with each other, is provided in the first side-flared portion 122S of the first cylinder 121S in order to suck the refrigerant from the external unit into the first inlet chamber 131S. The second inlet hole 135T, which causes the second inlet chamber 131T and the external unit to communicate with each other, is provided in the second side-flared portion 122T of the second cylinder 121T in order to suck the refrigerant from the external unit into the second inlet chamber 131T. The cross sectional shapes of the first inlet hole 135S and the second inlet hole 135T are circles.

As illustrated in FIG. 1, an intermediate partition plate 140 is disposed between the first cylinder 121S and the second cylinder 121T and partitions the first cylinder chamber 130S (refer to FIG. 2) of the first cylinder 121S from the second cylinder chamber 130T (refer to FIG. 2) of the second cylinder 121T. In addition, the intermediate partition plate 140 blocks an upper end portion of the first cylinder 121S and a lower end portion of the second cylinder 121T.

A lower end plate 160S is disposed on the lower end portion of the first cylinder 121S and blocks the first cylinder chamber 130S of the first cylinder 121S. In addition, an upper end plate 160T is disposed on the upper end portion of the second cylinder 121T and blocks the second cylinder chamber 130T of the second cylinder 121T. The lower end plate 160S blocks the lower end portion of the first cylinder 121S and the upper end plate 160T blocks the upper end portion of the second cylinder 121T.

A sub-bearing unit 161S is formed on the lower end plate 160S, and a sub-axis unit 151 of the rotation axis 15 is rotatably supported by the sub-bearing unit 161S. A main-bearing unit 161T is formed on the upper end plate 160T, and a main-axis unit 153 of the rotation axis 15 is rotatably supported by the main-bearing unit 161T.

The rotation axis 15 includes a first eccentric portion 152S and a second eccentric portion 152T which are eccentric to each other by deviating the phases thereof by 180°. The first eccentric portion 152S is rotatably fitted in the first annular piston 125S of the first compressing unit 12S. The second eccentric portion 152T is rotatably fitted in the second annular piston 125T of the second compressing unit 12T.

If the rotation axis 15 is rotated, the first annular piston 125S revolves along the first cylinder inner wall 123S in the first cylinder 121S in a clockwise direction in FIG. 2. The first vane 127S is moved in a reciprocating manner by following the revolution of the piston. According to the movement of the first annular piston 125S and the first vane 127S, the volumes of the first inlet chamber 131S and the first compression chamber 133S are continuously changed, and thus the compressing unit 12 continuously sucks, compresses, and discharges the refrigerant in sequence. If the rotation axis 15 is rotated, the second annular piston 125T revolves along the second cylinder inner wall 123T in the second cylinder 121T in the clockwise direction in FIG. 2. The second vane 127T is moved in a reciprocating manner by following the revolution of the piston. According to the movement of the second annular piston 125T and the second vane 127T, the volumes of the second inlet chamber 131T and the second compression chamber 133T are continuously changed, and thus the compressing unit 12 continuously sucks, compresses, and discharges the refrigerant in sequence.

As illustrated in FIG. 1, a cover for lower end plate 170S is disposed on the lower side of the lower endplate 160S and a lower muffler chamber 180S is formed between the cover for lower end plate 170S and the lower end plate 160S. The first compressing unit 12S is opened toward the lower muffler chamber 180S. That is, a first outlet 190S (refer to FIG. 2) that communicates with the first compression chamber 133S of the first cylinder 121S and the lower muffler chamber 180S is provided on the lower end plate 160S in the vicinity of the first vane 127S. A reed valve type first discharge valve 200S that prevents backflow of the compressed refrigerant is disposed in the first outlet 190S.

The lower muffler chamber 180S is one chamber formed in an annular shape, and is a part of a communication path which causes the discharging side of the first compressing unit 12S to communicate with the inside of an upper muffler chamber 180T through a refrigerant path 136 (refer to FIG. 2) that penetrates the lower end plate 160S, the first cylinder 121S, the intermediate partition plate 140, the second cylinder 121T, and the upper endplate 160T. The lower muffler chamber 180S reduces the pressure pulsation of the discharged refrigerant. A first discharge valve cover 201S for restricting an opening amount of bent of the first discharge valve 200S is fixed together with the first discharge valve 200S by a rivet so as to overlap the first discharge valve 200S. The first outlet 190S, the first discharge valve 200S, and the first discharge valve cover 201S configure a first discharge valve unit of the lower end plate 160S.

As illustrated in FIG. 1, a cover for upper end plate 170T is disposed on the upper side of the upper end plate 160T and the upper muffler chamber 180T is formed between the cover for upper end plate 170T and the upper end plate 160T. A second outlet 190T (refer to FIG. 2), which communicates with the second compression chamber 133T of the second cylinder 121T and the upper muffler chamber 180T, is provided on the upper end plate 160T in the vicinity of the second vane 127T. A reed valve type second discharge valve 200T, which prevents backflow of the compressed refrigerant, is disposed in the second outlet 190T. A second discharge valve cover 201T for restricting an opening amount of bent of the second discharge valve 200T is fixed together with the second discharge valve 200T by a rivet so as to overlap the second discharge valve 200T. The upper muffler chamber 180T reduces the pressure pulsation of the discharged refrigerant. The second outlet 190T, the second discharge valve 200T, and the second discharge valve cover 201T configure a second discharge valve unit of the upper end plate 160T.

The cover for lower end plate 170S, the lower end plate 160S, the first cylinder 121S, and the intermediate partition plate 140 are inserted from the lower side and are fastened to the second cylinder 121T by using a plurality of penetrating bolts 175 that are screwed into female screws provided on the second cylinder 121T. The cover for upper end plate 170T and the upper end plate 160T are inserted from the upper side and are fastened to the second cylinder 121T by using a penetrating bolt (not illustrated) that is screwed into the female screw provided on the second cylinder 121T. The cover for lower end plate 170S, the lower end plate 160S, the first cylinder 121S, the intermediate partition plate 140, the second cylinder 121T, the upper end plate 160T, and the cover for upper end plate 170T, which are integrally fastened by using the plurality of penetrating bolts 175 and the like, configure the compressing unit 12. In the compressing unit 12, the outer circumferential portion of the upper end plate 160T is fixed to the compressor housing 10 by spot welding, and thus the compressing unit 12 is fixed to the compressor housing 10.

A first through hole 101 and a second through hole 102 are provided on the outer circumferential wall of the compressor housing 10 having a cylindrical shape, in order starting from the lower part by being separated from each other in an axial direction, in order for a first inlet pipe 104 and a second inlet pipe 105 to respectively pass therethrough. In addition, in the outer side portion of the compressor housing 10, an independent accumulator 25 formed of a cylindrical sealed container is held by an accumulator holder 252 and an accumulator band 253.

A system connecting pipe 255 that is connected to an evaporator of a refrigerant circuit is connected to the center of a top of the accumulator 25. A first low-pressure communication tube 31S, which has one end extending up to the upper portion inside the accumulator 25 and the other end connected to the other end of the first inlet pipe 104, and a second low-pressure communication tube 31T, which has one end extending up to the upper portion inside the accumulator 25 and the other end connected to the other end of the second inlet pipe 105, are fixed to bottom through holes 257 provided on a bottom of the accumulator 25.

The first low-pressure communication tube 31S that guides a low pressure refrigerant of the refrigerant circuit to the first compressing unit 12S through the accumulator 25 is connected to the first inlet hole 135S (refer to FIG. 2) of the first cylinder 121S through the first inlet pipe 104 as an intake unit. In addition, the second low-pressure communication tube 31T that guides the low pressure refrigerant of the refrigerant circuit to the second compressing unit 12T through the accumulator 25 is connected to the second inlet hole 135T (refer to FIG. 2) of the second cylinder 121T through the second inlet pipe 105 as the intake unit. That is, the first inlet hole 135S and the second inlet hole 135T are connected to the evaporator of the refrigerant circuit in parallel.

A discharge pipe 107 as a discharging unit that is connected to the refrigerant circuit and discharges the high pressure refrigerant to a condenser side of the refrigerant circuit is connected to the top of the compressor housing 10. That is, the first outlet 190S and the second outlet 190T are connected to the condenser of the refrigerant circuit.

In the compressor housing 10, the lubricant oil is enclosed approximately up to the height of the second cylinder 121T. In addition, the lubricant oil is sucked through a lubricating pipe 16, which is attached to the lower end portion of the rotation axis 15, by a pump impeller (not illustrated) inserted into a lower portion of the rotation axis 15, and circulates in the compressing unit 12, thereby performing lubrication between sliding components (the first annular piston 125S and the second annular piston 125T) and performing sealing of a minute gap of the compressing unit 12.

Figure 3:
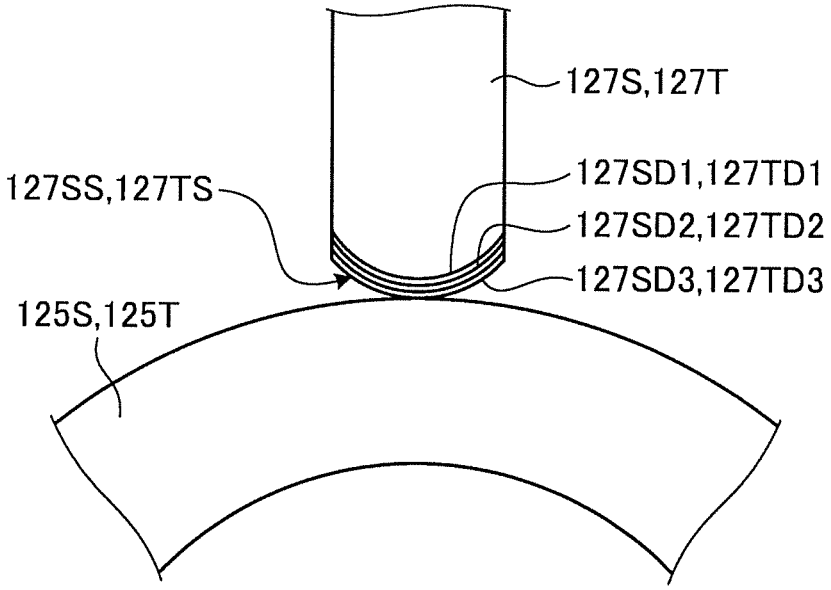
FIG. 3 is a partial sectional view illustrating a sliding portion of a first annular piston, a second annular piston, a first vane, and a second vane of the example.

Next, the characteristic configuration of the rotary compressor 1 of the example will be described with reference to FIG. 3. FIG. 3 is a partial sectional view illustrating a sliding portion of first and second annular pistons, and first and second vanes of the example. As illustrated in FIG. 3, parent materials of the first vane 127S and the second vane 127T of the example are steel materials such as high-speed tool steel (SKH51: as the constituent element, chromium is contained) or high-carbon chromium bearing steel (SUJ2). As the first layer, single coating layers 127SD1 and 127TD1 of chromium, which is a constituent element of the parent material, are formed on sliding surfaces 127SS and 127TS with respect to the first annular piston 125S and the second annular piston 125T (the sliding surfaces 127SS and 127TS are surfaces where the first vane 127S and the second vane 127T are in contact with the first annular piston 125S and the second annular piston 125T, and where the first annular piston 125S and the second annular piston 125T slide with respect to the first vane 127S and the second vane 127T in accordance with the rotation thereof). The thickness of the single coating layers 127SD1 and 127TD1 of chromium as the first layer is 0.05 μm to 0.30 μm.

Since chromium is contained in the parent material, the single coating layers 127SD1 and 127TD1 of chromium as the first layer can be easily formed as thin films having a thickness of 0.05 μm to 0.30 μm. In addition, since the hardness of the parent material is sufficiently high, it is possible to obtain a thin film structure having low internal residual stress.

Next, as the second layer, intermediate coating layers 127SD2 and 127TD2 having a concentration gradient of chromium and carbon are formed on the outer side of the single coating layers 127SD1 and 127TD1 of chromium as the first layer. As the third layer, diamond-like carbon coating layers 127SD3 and 127TD3 are formed on the outer side of the intermediate coating layers 127SD2 and 127TD2 as the second layer.

In the intermediate coating layers 127SD2 and 127TD2 as the second layer, the content rate (concentration) of chromium is higher on the first layer side than on the third layer side, and the content rate (concentration) of carbon is higher on the third layer side than on the first layer side. The thickness of the intermediate coating layers 127SD2 and 127TD2 as the second layer is 0.30 μm to 1.20 μm, and the thickness of the diamond-like carbon coating layers 127SD3 and 127TD3 as the third layer is 1.00 μm to 3.00 μm. Since the diamond-like carbon coating layers 127SD3 and 127TD3 as the third layer have surface roughness (arithmetic mean surface roughness) of about Ra 0.8, the thickness thereof is set to be thicker than the range of 1.00 μm to 3.00 μm (if the thickness is thinner than the range, a hole may be formed on the coating layer). Each coating layer of the first to third layers described above is formed by an ionic vapor deposition method which is a plasma process in high vacuum.

In the intermediate coating layers 127SD2 and 127TD2 as the second layer, if the content rate of chromium of the bonding surface with respect to the single coating layers 127SD1 and 127TD1 of chromium as the first layer is set to 100% by weight, and the content rate of chromium of the bonding surface with respect to the diamond-like carbon coating layers 127SD3 and 127TD3 as the third layer is set to 0% by weight, it is possible to obtain the maximum bonding force between layers of the first to third layers.

The single coating layers 127SD1 and 127TD1 of chromium as the first layer improve bonding properties between the parent material of the first vane 127S and the second vane 127T, and the intermediate coating layers 127SD2 and 127TD2 as the second layer. The intermediate coating layers 127SD2 and 127TD2 as the second layer are bonding layers with the diamond-like carbon coating layers 127SD3 and 127TD3 as the third layer. In addition, the first vane 127S and the second vane 127T move in a reciprocating manner so as to apply impact to the first annular piston 125S and the second annular piston 125T through the hard diamond-like carbon coating layers 127SD3 and 127TD3, but the intermediate coating layers 127SD2 and 127TD2 as the second layer become buffer layers for buffering the impact.

By adopting the layer structure of the first to third layers described above, it is possible to improve peeling strength of the diamond-like carbon coating layers 127SD3 and 127TD3 as the third layer without causing the intermediate coating layers 127SD2 and 127TD2 as the second layer to be complicated and thickened. Therefore, it is possible to obtain the layer structure having low internal residual stress (if the single coating layers 127SD1 and 127TD1 of chromium and the intermediate coating layers 127SD2 and 127TD2 are too thin, the bonding properties between layers become worse, and further, if the layers are too thick, the internal residual stress between layers is increased and thus the peeling and breaking strength is lowered). In addition, since tungsten is not contained, it is possible to further improve the peeling strength. As a result, it is possible to obtain the first vane 127S and the second vane 127T which have excellent abrasion resistance properties, and can be stably used for a long period of time and in which an increase in costs is suppressed.

In the rotary compressor 1 of the example, the first annular piston 125S and the second annular piston 125T are formed of flaky graphite cast iron containing molybdenum, nickel, and chromium, and the first cylinder 121S and the second cylinder 121T are formed of cast iron. The invention can be applied to a single cylinder type rotary compressor and a two-stage compression type rotary compressor.

Hereinbefore, the example has been described, but the example is not limited by the contents described above. In addition, the components described above include those that can be easily conceived by those skilled in the art, those that are substantially identical thereto, and those in a scope of so-called equivalents. In addition, the components described above can be appropriately combined. Furthermore, at least one of various omission, replacement, and modification of the components can be performed without departing from the gist of the example.

According to an aspect of the embodiments, it is possible to prevent a coating layer formed on a sliding surface of a vane in contact with an annular piston from being peeled off and to suppress an increase in costs for the vane.

What is claimed is:

1. A rotary compressor comprising:

a sealed vertical compressor housing in which a refrigerant discharging unit is provided at a side of an upper part of the compressor housing and a refrigerant intake unit is provided at a side surface of a lower part of the compressor housing;

a compressing unit which is disposed on the lower part of the compressor housing, includes an annular cylinder, an end plate including a bearing unit and a discharge valve unit and blocking end portions of the annular cylinder, an annular piston that engages with an eccentric portion of a rotation axis supported by the bearing unit, revolves along a cylinder inner wall of the annular cylinder in the annular cylinder, and forms a cylinder chamber between the cylinder inner wall and the annular piston, and a vane that protrudes away from a vane groove provided in the annular cylinder into the cylinder chamber and is in contact with the annular piston so as to divide the cylinder chamber into an inlet chamber and a compression chamber, sucks a refrigerant through the refrigerant intake unit, and discharges the refrigerant from the refrigerant discharging unit through the compressor housing; and a motor that is disposed on the upper part of the compressor housing, and drives the compressing unit via the rotation axis, wherein a parent material of the vane is a steel material containing chromium, a single coating layer of chromium as a first layer, an intermediate coating layer including a concentration gradient of chromium and carbon as a second layer, and a diamond-like carbon coating layer as a third layer are formed on a sliding surface in contact with the annular piston, in order starting from a surface of the parent material, the intermediate coating layer has a chromium concentration higher than a carbon concentration on the first layer side, and the intermediate coating layer has the carbon concentration higher than the chromium concentration on the third layer side, and the intermediate coating layer has the concentration gradient of chromium in which a content rate of chromium of a bonding surface with respect to the single coating layer of chromium as the first layer is 100% by weight, and the content rate of chromium of the bonding surface with respect to the diamond-like carbon coating layer as the third layer is 0% by weight.

* * * * *